US006820405B2

(12) United States Patent
Schaad

(10) Patent No.: US 6,820,405 B2
(45) Date of Patent: Nov. 23, 2004

(54) DEVICE FOR PRODUCING EFFECT YARNS AND USE OF THE DEVICE

(75) Inventor: Marc Schaad, Lenzburg (CH)

(73) Assignee: Scharer Schweiter Mettler AG (CH)

( * ) Notice: Subject to any disclaimer, the term of this patent is extended or adjusted under 35 U.S.C. 154(b) by 111 days.

(21) Appl. No.: 10/195,254

(22) Filed: Jul. 15, 2002

(65) Prior Publication Data

US 2003/0029152 A1 Feb. 13, 2003

(30) Foreign Application Priority Data

Jul. 21, 2001 (EP) ..... 01117809

(51) Int. Cl.[7] ..... D01H 13/00; D02G 3/34
(52) U.S. Cl. ..... 57/90; 57/91; 57/209
(58) Field of Search ..... 57/90, 91, 209

(56) References Cited

U.S. PATENT DOCUMENTS

| | | | | | |
|---|---|---|---|---|---|
| 2,920,345 | A | * | 1/1960 | Dyer | 425/66 |
| 3,025,563 | A | * | 3/1962 | Carman | 425/66 |
| 4,080,777 | A | * | 3/1978 | Griset, Jr. | 57/208 |
| 4,124,973 | A | | 11/1978 | Hense et al. | 57/207 |
| 4,305,245 | A | * | 12/1981 | Eschenbach | 57/6 |
| 4,343,071 | A | * | 8/1982 | Schroder | 28/254 |
| 5,307,616 | A | * | 5/1994 | Goineau et al. | 57/284 |
| 5,317,791 | A | * | 6/1994 | Adam | 28/252 |
| 5,908,170 | A | * | 6/1999 | Kunz | 242/477.3 |
| 5,918,829 | A | | 7/1999 | Fah | 242/481.4 |
| 6,505,791 | B1 | * | 1/2003 | Syndikus et al. | 242/477.2 |

FOREIGN PATENT DOCUMENTS

| | | | | |
|---|---|---|---|---|
| EP | 0453622 | | 4/1990 | |
| EP | 0838422 | | 10/1996 | |
| EP | 0829444 | | 3/1998 | |
| EP | 1112953 | | 7/2001 | |
| EP | 1125878 | A2 * | 8/2001 | B65H/54/28 |
| EP | 1126058 | A2 * | 8/2001 | D01H/4/50 |
| EP | 1319622 | A1 * | 6/2003 | B65H/59/38 |
| JP | 6021930 | | 2/1985 | |
| WO | WO 9965810 | A1 * | 12/1999 | B65H/54/28 |

* cited by examiner

*Primary Examiner*—John J. Calvert
*Assistant Examiner*—Shaun R Hurley
(74) *Attorney, Agent, or Firm*—Baker Botts LLP

(57) ABSTRACT

The device serves to produce effect yarns on process machines through the deliberate production of short lumps in the yarn through short-duration yarn overfeed and includes a device (A) for lateral yarn deflection which comprises a motor-driveable, servo-controlled yarn guide (3) with an adjustable stroke. A movement of the yarn guide (3) in the one direction effects a slight underfeed and a movement in the other direction effects a pronounced overfeed of the yarn (F, $F_2$). The yarn guide (3) is attached to a traverse-motion element (2), formed by a flexible member which is rigid in the stroke direction, preferably by a wire rope, a string or a belt, by which it is driven. The yarn guide (3) effects the storage of a yarn length, in the form of a loop, which corresponds to the desired overfeed. The device is used in false-twist and air texturing machines.

12 Claims, 2 Drawing Sheets

DEVICE FOR PRODUCING EFFECT YARNS AND USE OF THE DEVICE

FIELD OF THE INVENTION

The present invention relates to a device for producing effect yarns on process machines through the deliberate production of short lumps in the yarn through short-duration yarn overfeed.

BACKGROUND OF THE INVENTION

Individuality in the design of textiles is ever-more frequently determining the development of special and high-quality finished yarns. In the area of process machines, particularly in the case of air and false-twist texturing machines, effect yarns are assuming increasing importance in yarn finishing. Different methods and different machines are known for the production of effect yarns, although the fundamental principle for the short lumps in the yarn, termed slubs, is always the same. Filament yarns are tied into the air texturing nozzle or false-twist zone, through short-duration overfeed according to predefined formulas, in such a way that fine or intensive structure effects are produced. Due to the yarn overfeed, the resultant slubs have a greater yarn cross section and have a typical length of between 20 and 100 mm. The slubs can be varied according to the magnitude and duration of the increased overfeed. The spacing of the slubs is controlled by the time interval between the overfeeds. To date, this method has only been applied to air texturing machines, but application to false-twist texturing is also conceivable.

Presently, two types of unit are used for producing effect yarns, the HemaSlub method developed and marketed by Heberlein AG, and an even older system which uses a yarn deflection lever which controls the overfeed through a periodic movement. The HemaSlub device is a feed mechanism, which can be integrated into the air-jet texturing process, with electronically controlled pressure rollers and an effect yarn generator. This feed mechanism can be mounted on different machines and is simple to operate, but it is relatively elaborate and costly, and can only be used in a yarn line with unheated godets. The older system with the yarn deflection lever, while simple and cost effective, has only a limited application since only relatively small yarn deflections are possible.

SUMMARY OF THE INVENTION

The object of the present invention is to provide a device for producing effect yarns which is cost effective and simple to install, the use of which makes it possible to retain not only the standard yarn line with unheated godets but also that with heated godets. This object is achieved, according to the present invention, by a device for lateral yarn deflection, which comprises a motor-driveable, servo-controlled yarn guide with an adjustable stroke. Movement of the yarn guide in one direction effects a slight underfeed, and movement in the other direction effects a pronounced overfeed of the yarn.

In a preferred embodiment of the device according to the invention, the yarn guide is attached to a traverse-motion element, preferably by a wire rope, a string or a belt. The traverse-motion element is formed by a flexible member which is rigid in the stroke direction by which it is driven. This embodiment is of the type of the yarn transfer devices, described in EP-A-0 453 622 and EP-A-0 829 444, for winding a yarn on to a bobbin. Since this system has a very small mass, very steep flanks of the slubs can be achieved. In addition, due to the high dynamics, high yarn speeds can be achieved. Since the drive system is servo-controlled, it is also possible for almost any acceleration and speed profiles to be achieved.

In another preferred embodiment of the device according to the invention, the yarn guide is formed by a lever which can be driven in an oscillating manner, or is disposed on such a lever. This preferred embodiment, can be of the type of the yarn transfer device described in U.S. Pat. No. 5,908,170, which is incorporated herein by reference. It is particularly suitable for short slubs because the stroke of the lever is naturally smaller than that of the traverse-motion element formed by a flexible member.

In another preferred embodiment of the device according to the invention, the yarn guide effects the storage of a yarn length, in the form of a loop, which corresponds to the desired overfeed. And in a related preferred embodiment of the device according to the invention, when the stored yarn length is released, the drive of the yarn guide is controlled in relation to the volume and length of the slub to be produced.

In yet another preferred embodiment of the present invention, after production of a slub, the yarn guide is driven as slowly as possible when returned into the deflection position for the next overfeed.

The present invention also relates to the use of the aforesaid device on a false-twist texturing machine. In this instance, the device for the lateral yarn deflection is preferably disposed in the yarn line immediately before the inlet of the heating element of the machine.

The present invention also relates to the use of the aforesaid novel device on air texturing machine. Here, the device for lateral yarn deflection is preferably disposed directly before the air-jet texturing nozzle.

BRIEF DESCRIPTION OF THE DRAWINGS

The present invention is described in greater detail below with reference to embodiments, examples, and the drawings in which.

DETAILED DESCRIPTION OF THE INVENTION

Figure 1:
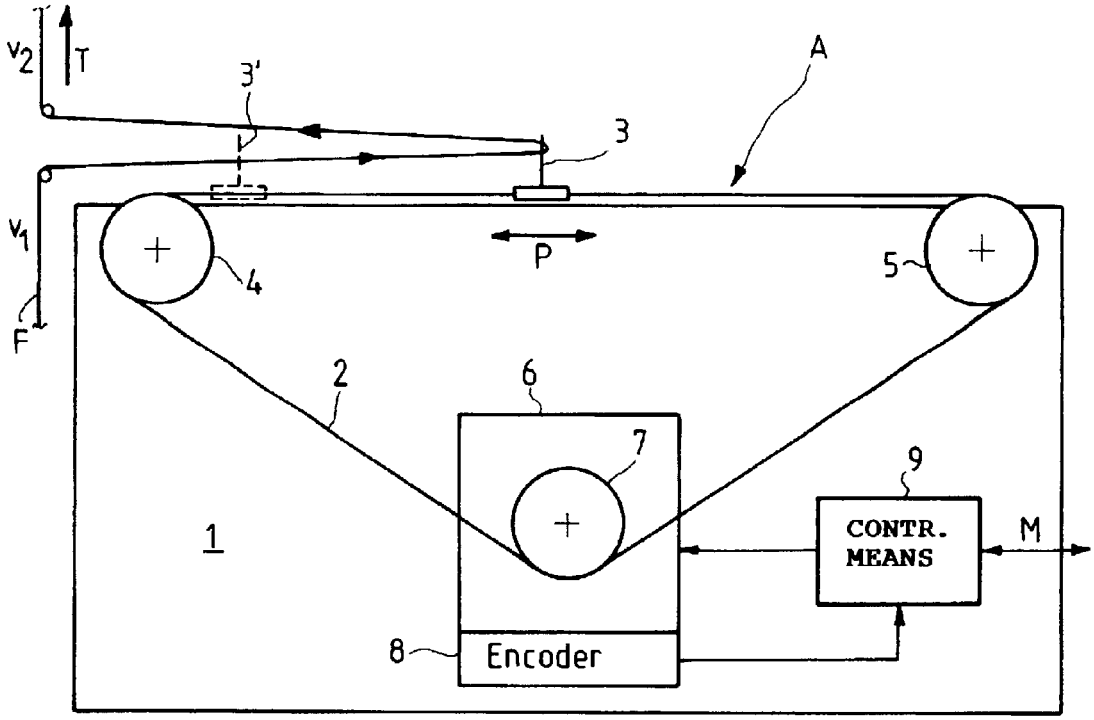
FIG. 1 schematically illustrates a device according to the invention.

FIG. 1 shows a unit A for producing effect yarn, according to the invention, which utilizes the yarn transfer devices described in EP-A-0 453 622 and in EP-A-0 829 444. The unit A comprises a base plate 1, a yarn guide 3, attached to a traverse-motion element 2, and its drive and guidance system. The yarn guide 3 is driven in an oscillating manner, in the direction of the arrow P, by the traverse-motion element 2. The traverse-motion element 2 is designed as a flexible member, which is rigid in the traverse-motion direction P, for the purpose of transmitting tensile forces, and is formed by, for example, a string, a wire, a metal rope, a flat, toothed or V-belt, a metal band, a chain or the like. The traverse-motion element 2 runs over two deflection rollers 4 and 5, mounted on the base plate 1, and over a drive wheel 7 which is driven by a servomotor 6, preferably a stepping motor. It passes around the drive wheel 7 with several windings and is attached to it at both ends.

An encoder 8 is assigned to the motor 6 for detecting the rotational position of the drive wheel 7 and, thereby, the traverse-motion position of the yarn guide 3. The encoder 8 is a photoelectric sensor, consisting of a transmitting and a receiving diode, which scans the motion of a disc (not illustrated; but, see, in this connection, U.S. Pat. No. 5,918,829), which is rigidly joined to the drive wheel 7. For this purpose, the disc is provided with appropriate optically scannable markings, for example, with holes or slots disposed along a circle. The sensor signal is supplied to a controller 9 which checks whether the motor 6 is running at the rotational speed provided for the respective position of the yarn guide. In the event of variations between an actual and a setpoint value, the controller delivers a corresponding control signal to the motor 6. A further output M of the controller 9 is connected to the machine controller.

Unit A serves as a means for laterally deflecting a yarn F passing through a process machine, for the purpose of effecting an overfeed of the yarn in the subsequent process stage. The unit is arranged such that the traverse motion direction P runs, essentially, approximately perpendicular to the yarn line direction T. With respect to its function, it has a certain similarity to a weft storage device for an air-jet weaving machine, which stores a defined length of yarn in the form of a loop and then releases it under control.

When the yarn F is supplied to unit A at a speed $v_1$, and the yarn guide 3 executes a stroke movement from right to left, the drawing-off speed $v_2$ and, consequently, the delivery speed to the subsequent process stage, is greater than $v_1$. The difference between $v_2$ and $v_1$ depends on the speed of the yarn guide 3. In this way, a short-duration overfeed occurs in the subsequent process stage, resulting in a slub yarn. The instant, duration and speed of the movement of the yarn guide 3 are controlled by the controller 9 and synchronized with the delivery speed of the yarn F, with the encoder 8 monitoring the said parameters. Since the drive of the yarn guide 3 is servo-controlled, almost any acceleration and speed profiles can be created. In addition, due to the small mass of the yarn guide 3, and its drive, very steep flanks of the slubs can be achieved.

The yarn length deflected by the yarn guide 3 determines the overfeed available for a slub, so that there is thus effected a smaller deflection of the yarn for a shorter slub, and a greater deflection of the yarn for a longer slub, with corresponding positioning of the yarn guide 3. If, in the case of the embodiment as shown in FIG. 1, an overfeed is effected and the yarn guide 3 has been moved from the represented deflection position into the position represented by the broken line and denoted by 3', it must then be moved into the deflection position required for the next slub This is effected by a very slow return movement over the yarn section to the next slub. This return movement is associated with an underfeed, but this does not result in a fault because the yarn section to the next slub is generally longer, by orders of magnitude, than the slub itself. Thus, for example, the length of the slub can be 70 mm and the length of the subsequent yarn section without a slub 5 mm or more.

As previously mentioned, a unit with a rocking lever which can be driven in an oscillating manner can also be used instead of the unit A with a flexible traverse-motion element illustrated in FIG. 1. The rocking lever can be, for example, of the type of the yarn transfer lever described in U.S. Pat. No. 5,908,170, it being possible to omit the energy storage device for influencing the deceleration or acceleration of the yarn transfer lever on its movement reversal. Such a rocking lever would also be driven by a servomotor with an assigned encoder. Since the stroke of the rocking lever is naturally smaller than that of the yarn guide 3 of the unit A, the application of the unit with the rocking lever would be restricted to shorter slubs.

Figure 2:
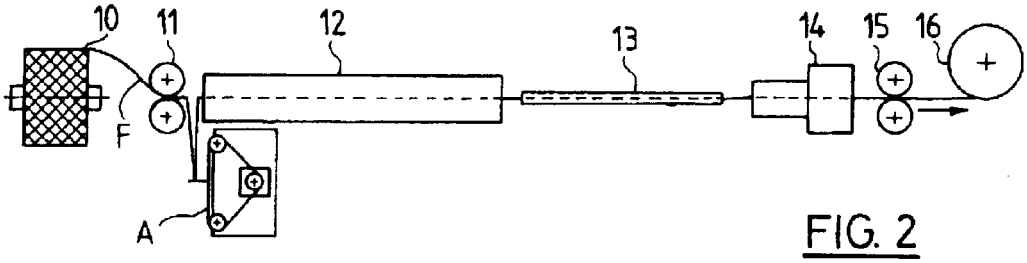
FIG. 2 schematically illustrates a false-twist texturing machine fitted with a device according to the invention.
Figure 3:
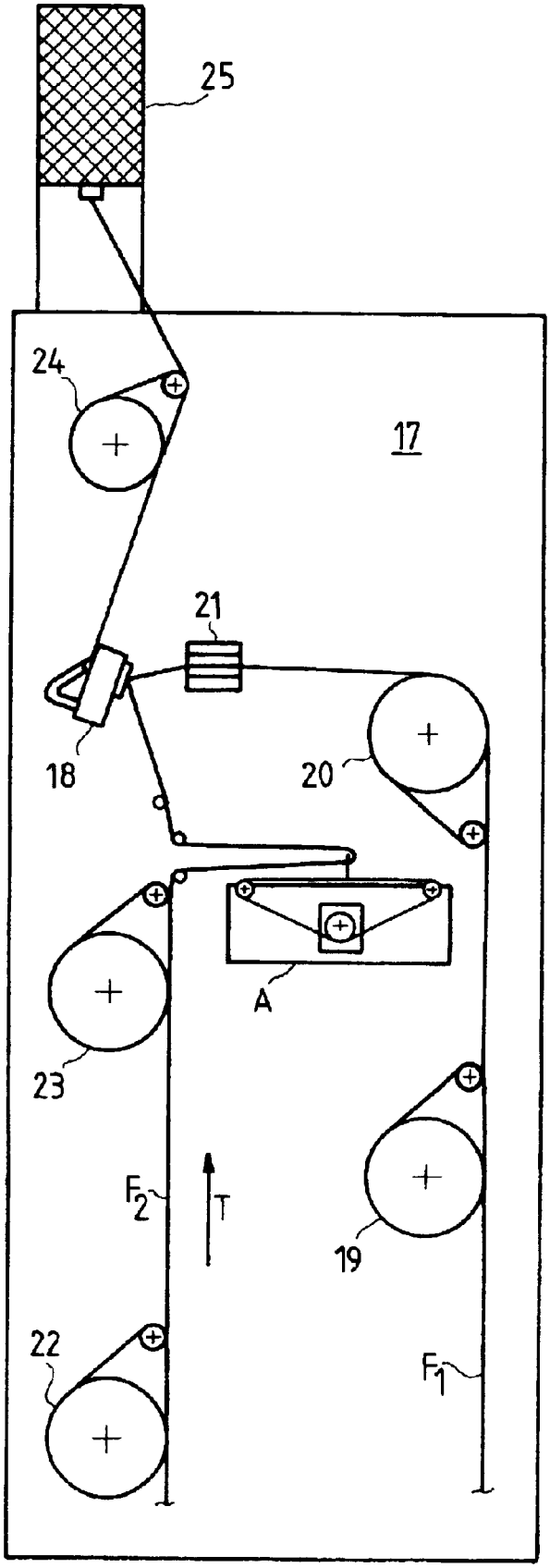
FIG. 3 schematically illustrates an air texturing machine fitted with a device according to the invention.

FIGS. 2 and 3 each show, respectively, an example for the use of the unit A on a false-twist texturing machine and air texturing machine. According to FIG. 2, in the case of the false-twist texturing method, which is also termed friction texturing, the feeder yarn F drawn off from a bobbin 10 passes through a first feed mechanism 11, a heating element 12, a cooling rail 13, a friction unit 14 and a second feed mechanism 15, and is finally delivered to a winding unit 16. The heating element 12, which is represented as an oblong design, can also be formed by a heating godet, i.e., a heated roller around which are passed several windings of the yarn F.

The unit A is disposed between the first feed mechanism 11 and the heating element 12. In the case of false-twist texturing, the yarn is twisted and thermally set, in the twisted state, through heating and subsequent cooling. Following untwisting, the filaments, with their set helix structure, form a yarn with a high volume and high elastic stretching ability. The twist is preferably transmitted by means of a triaxial disc friction unit, the axles of which lie parallel to the yarn line direction and form the corner points of an equilateral triangle. In this case, the feeder yarn F denotes core and effect yarn, only the effect yarn being deflected, however, by the unit A.

The texturing zone, and the drawing zone which is identical to the latter, extends from the first to the second feed mechanism 11 and 15 respectively, the twist zone extending from the first feed mechanism 11 to the friction unit 14 and the thermosetting zone extending from the inlet of the heating element 12 to the outlet of the cooling rail 13.

FIG. 3 shows a view of the working plate 17 of an air texturing machine on which there are disposed, amongst other things, an air-jet texturing nozzle 18 and, immediately in front of the latter in the yarn line direction T, the unit A. The delivered filament yarns $F_1$ and $F_2$ are tied-in in the air-jet texturing nozzle 18, $F_1$ denoting the so-called core yarn and $F_2$ the effect yarn. The core yarn $F_1$ runs over heating godets 19 and 20 to a yarn brake 21 and then passes into the air-jet texturing nozzle 18. The effect yarn $F_2$ runs over heating godets 22 and 23 to the unit A and from the latter to the air-jet texturing nozzle 18. Through short-duration high overfeed of the effect yarn $F_2$, the latter is tied-in in the air-jet texturing nozzle 18 so as to produce fine or intensive structure effects. The thus produced effect yarn passes from the air-jet texturing nozzle 18, via a take-up roller 24, to a winding bobbin 25.

The embodiment shown in FIG. 3 clearly shows that, due to its simple construction and small space requirement, the unit A can be easily incorporated in a standard yarn line with heating godets. Obviously, incorporation in a yarn line with a flat heating element does not present any problems.

I claim:

1. A yarn producing apparatus comprising means for producing effect yarns on process machines through a deliberate production of short lumps in the yarn through short-duration yarn overfeed said means, comprising a device for lateral yarn deflection having a motor-driveable, servo-controlled yarn guide with an adjustable stroke, whereby a movement of the yarn guide in one direction effects a slight underfeed and movement in another direction effects a pronounced overfeed of the yarn (F, $F_2$).

2. The apparatus according to claim 1, wherein the yarn guide is attached to a traverse-motion element, formed by a flexible member which is rigid in the stroke direction and by which the yarn guide is driven.

3. The apparatus according to claim 2, further comprising a servomotor for driving traverse-motion element, and an encoder for detecting the traverse-motion position of the yarn guide.

4. The apparatus according to claim 3, wherein the yarn guide effects storage of a yarn length, in the form of a loop, which corresponds to the desired overfeed.

5. The apparatus according to claim 4, wherein when the stored yarn length is released, the drive of the yarn guide is controlled based on the volume and length of a slub to be produced.

6. The apparatus according to claim 5, wherein following production of a slub, the yarn guide is driven as slowly as possible when returned to a deflection position for a next overfeed.

7. The apparatus according to claim 2, wherein said fleixble member is selected from the group consisting of a wire rope, string or a belt.

8. The apparatus according to claim 1, wherein the yarn guide is formed by or disposed on a lever which can be driven in an oscillating manner.

9. The apparatus according to claim 8, further comprising a servomotor for driving the lever, and an encoder for detecting the traverse-motion position of the yarn guide.

10. The apparatus according to claim 1, wherein the yarn guide effects storage of a yarn length, in the form of a loop, which corresponds to the desired overfeed.

11. The apparatus according to claim 10, wherein when a stored yarn length is released, the drive of the yarn guide is controlled based on the volume and length of a slub to be produced.

12. The apparatus according to claim 11, wherein following production of a slub, the yarn guide is driven as slowly as possible when returned to a deflection position for a next overfeed.

* * * * *